US009569941B1

(12) United States Patent
Sholl et al.

(10) Patent No.: US 9,569,941 B1
(45) Date of Patent: Feb. 14, 2017

(54) ANNOUNCING THE SELECTION OF MERCHANDISE AT A POINT-OF-PURCHASE

(71) Applicant: Henschel-Steinau, Inc., Allendale, NJ (US)

(72) Inventors: Andrew B. Sholl, Cranbury, NJ (US); Michael D. Luberto, River Vale, NJ (US); Michael D. DeSena, West Caldwell, NJ (US)

(73) Assignee: Henschel-Steinau, Inc., Allendale, NJ (US)

( * ) Notice: Subject to any disclaimer, the term of this patent is extended or adjusted under 35 U.S.C. 154(b) by 0 days.

(21) Appl. No.: 14/627,127

(22) Filed: Feb. 20, 2015

(51) Int. Cl.
*G08B 13/14* (2006.01)
*G08B 13/02* (2006.01)

(52) U.S. Cl.
CPC ..... *G08B 13/02* (2013.01)

(58) Field of Classification Search
CPC ..... G08B 13/08; A47F 1/126
USPC ..... 340/568.1, 568.8, 692, 309.16, 384.1; 211/592
See application file for complete search history.

(56) References Cited

U.S. PATENT DOCUMENTS 6,874,684 B1 4/2005 Denenberg et al.
7,347,335 B2 3/2008 Rankin, VI et al.
7,533,784 B2 5/2009 Vlastakis et al.
7,792,711 B2 9/2010 Swafford, Jr. et al.
7,918,353 B1 * 4/2011 Luberto ..... A47F 1/126 211/59.3
8,662,320 B2 3/2014 Csak
2005/0161420 A1 * 7/2005 Hardy ..... A47F 1/125 211/189
2007/0225860 A1 * 9/2007 Sheppard ..... G07F 17/20 700/236
2009/0248198 A1 10/2009 Siegel et al.
2011/0215060 A1 * 9/2011 Niederhuefner ..... G08B 13/14 211/59.3
2013/0002422 A1 1/2013 Wiese et al.
2014/0034592 A1 2/2014 Hardy
2014/0167962 A1 * 6/2014 Valiulis ..... G08B 13/14 340/568.8

* cited by examiner

*Primary Examiner* — Phung Nguyen
(74) *Attorney, Agent, or Firm* — Arthur Jacob

(57) ABSTRACT

An improvement in an apparatus and a method provide an audible signal for announcing a selection, by a purchaser, of an item of merchandise placed at a dispensing location at a point-of-purchase. An annunciator emits an audible signal of limited duration for announcing the selection. A motion-responsive activator is coupled with the annunciator for activating the annunciator to emit the audible signal in response to imparting an activating motion to the activator. A selection-responsive component is coupled with the activator and is movable in response to the purchaser making a selection at the dispensing location, to impart an activating motion to the activator and, consequently, to activate the annunciator to emit the audible signal of limited duration announcing the selection.

16 Claims, 7 Drawing Sheets

ANNOUNCING THE SELECTION OF MERCHANDISE AT A POINT-OF-PURCHASE

BACKGROUND OF THE INVENTION

Field of the Invention

The present invention relates generally to the display and dispensing of items of merchandise at a point-of-purchase and pertains, more specifically, to providing an audible alert upon the selection of an item of merchandise displayed at a dispensing location placed at the point-of-purchase.

Description of Related Art

It has become quite common in retail marketing to present items of merchandise at a point-of-purchase, attractively displayed at a convenient dispensing location for promoting selection by prospective purchasers. A wide variety of display and dispensing systems have been made available to retail outlets for pursuing that endeavor. Unfortunately, however, the ease with which a prospective purchaser is able to make a selection at such a point-of-purchase has led to an increase in theft, and concomitant significant losses suffered by retailers who utilize such systems. In an effort to combat such theft at a retail point-of-purchase, a number of merchandise display and dispensing systems have been developed in which the removal of an item of merchandise at a dispensing location will generate an alarm for alerting members of the retail staff of a possible theft. However, these available systems are relatively complex and expensive to purchase, install and operate.

BRIEF SUMMARY OF THE INVENTION

The present invention provides an improvement for deterring the theft of items of merchandise at a retail point-of-purchase where such items are presented for display and dispensing. As such, the present invention attains several objects and advantages, some of which are summarized as follows: Provides a simple, effective and relatively inexpensive improvement for deterring theft at an apparatus for displaying and dispensing items of merchandise at a point-of-purchase; is self-contained and compact, adapted easily to current designs of apparatus for displaying and dispensing items of merchandise at a point-of-purchase, rendering widespread use both practical and readily accepted; provides an announcement of a selection made at a dispensing location for items of merchandise, effective to deter theft at a point-of-purchase; places an unobtrusive mechanism in connection with a dispensing location for signaling a selection made at a point-of-purchase, with an audible signal of predetermined duration; enables ready installation and use, without the necessity for special facilities or utilities at the installation location; provides a highly effective system and method for deterring theft at a point-of-purchase, capable of reliable operation over a long service life.

The above objects and advantages, as well as further objects and advantages, are attained by the present invention which may be described briefly as an improvement for deterring theft at an apparatus for displaying and dispensing items of merchandise arranged serially and advanced along a path of travel to a dispensing location at a point-of-purchase, at which dispensing location a purchaser may select an item of merchandise placed at the dispensing location, the improvement comprising: an annunciator assembly mounted within the apparatus, the annunciator assembly including an annunciator for emitting an audible signal of limited duration upon activation of the annunciator; a motion-responsive activator coupled with the annunciator for activating the annunciator to emit an audible signal of limited duration in response to imparting an activating motion to the activator; and a selection-responsive component mounted upon the apparatus in juxtaposition with the path of travel and coupled with the activator, the selection-responsive component being movable in response to effecting a selection at the dispensing location to impart an activating motion to the activator and, consequently, activating the annunciator to emit an audible signal of limited duration announcing the selection.

In addition, the present invention provides a method for announcing the selection of an item of merchandise presented at an apparatus for displaying and dispensing items of merchandise arranged serially and advanced along a path of travel to a dispensing location at a point-of-purchase, at which dispensing location a purchaser may select an item of merchandise placed at the dispensing location, the method comprising: mounting an annunciator assembly within the apparatus, the annunciator assembly including an annunciator for emitting an audible signal of limited duration upon activation of the annunciator; coupling a motion-responsive activator with the annunciator for activating the annunciator to emit an audible signal of limited duration in response to imparting an activating motion to the activator; and mounting a selection-responsive component upon the apparatus in juxtaposition with the path of travel and coupled with the activator, such that the selection-responsive component is movable in response to effecting a selection at the dispensing location to impart an activating motion to the activator and, consequently, activating the annunciator to emit an audible signal of limited duration announcing the selection.

BRIEF DESCRIPTION OF THE SEVERAL VIEWS OF THE DRAWING

The present invention will be understood more fully, while still further objects and advantages will become apparent, in the following detailed description of preferred embodiments illustrated in the accompanying drawing, in which.

DETAILED DESCRIPTION OF THE INVENTION

Figure 1:
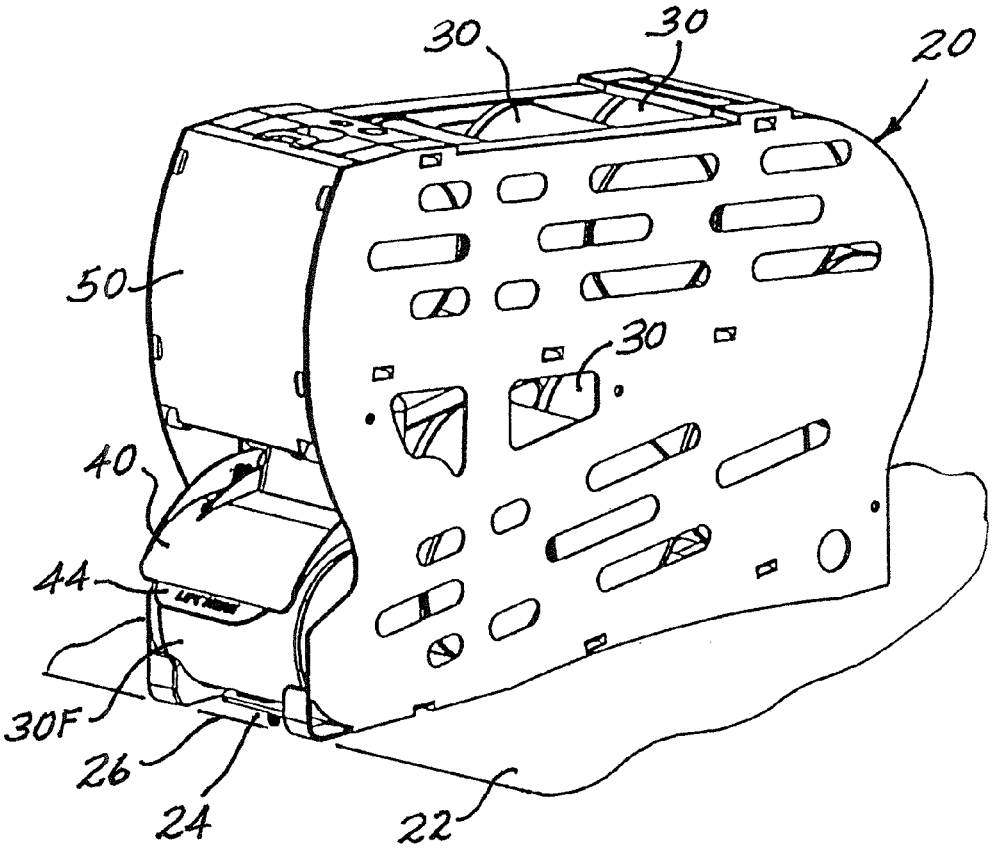
FIG. 1 is a top, front, right side pictorial view of an apparatus incorporating the improvement of the present invention.
Figure 2:
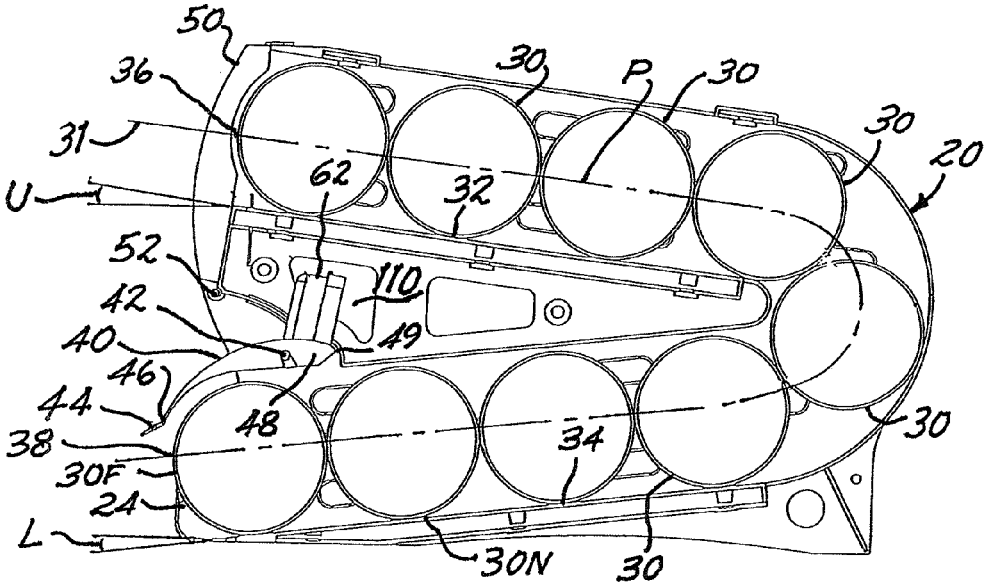
FIG. 2 is a partially diagrammatic, longitudinal cross-sectional view of the apparatus.
Figure 3:
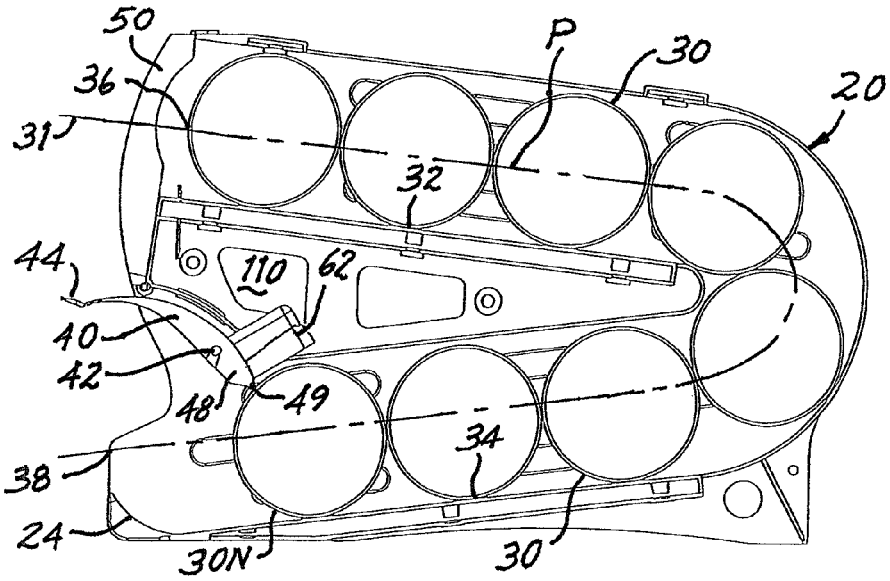
FIG. 3 is a partially diagrammatic, longitudinal cross-sectional view similar to FIG. 2, with component parts in another operating position.

Referring now to the drawing, and especially to FIGS. 1 through 3 thereof, an apparatus for displaying and dispensing items of merchandise is shown at 20 and is seen to be placed on a shelf 22 extending along a horizontal direction to establish a dispensing location 24 at a point-of-purchase 26 where a purchaser (not shown) may select an item of merchandise, shown in the form of items 30, to be dispensed at the dispensing location 24 for purchase at the point-of-purchase 26. Apparatus 20 is of the type known as a "gravity-feed" display and dispensing apparatus which dispenses a forward-most item 30F from a plurality of items 30 arranged serially, in a column 31, along an upper chute 32 and a lower chute 34. Each item 30 includes a cylindrical profile configuration, as viewed in FIGS. 2 and 3, and the upper chute 32 is oriented at an angle U to the horizontal direction, while the lower chute 34 is oriented at an angle L such that items 30 are biased by gravity to roll down a path of travel P from an upper end 36 to a lower end 38 of the path of travel P. An access door 40 is located adjacent lower end 38, juxtaposed with dispensing location 24, and is shown in FIG. 2 in a first, or closed, position where access to the forward-most item 30F at the dispensing location 24 is precluded. Access door 40 is mounted for pivotal movement about a fixed pivot 42 and includes a finger-grip 44 at a forward end 46 of the access door 40 such that upon a purchaser making a selection, finger-grip 44 is engaged and access door 40 is lifted for pivotal movement into a second, or open position, seen in FIG. 3, wherein the access door 40 is raised, opening access to the item 30F at the dispensing location 24 for selective removal of item 30F. At the same time, a nose 48 at the rearward end 49 of the access door 40, opposite the forward end 46 and finger-grip 44, is lowered to intercept the next-consecutive item 30N and preclude movement of the next-consecutive item 30N into the dispensing location 24 until access door 40 is returned to the first position shown in FIG. 2, at which time the column 31 of items 30 will be biased by gravity to roll down upper and lower chutes 32 and 34 and present the next-consecutive item 30N at the dispensing location 24. In this manner, items 30 are dispensed only one-at-a-time. A loading door 50 at the upper end 36 of path of travel P is hinged at 52 to allow access to the upper chute 32 for re-stocking items 30, as required. Such access to the upper chute 32 ordinarily is restricted to authorized personnel only, as by locking loading door 50 closed.

While display and dispensing devices, including gravity-feed arrangements similar to apparatus 20, have become quite prevalent, in view of their ability to attract purchasers and provide for convenient selection and increased sales, these devices also have resulted in increased losses due to theft. As a result, alarms have been devised to signal when an item of merchandise is removed from a dispensing location at a point-of-sale, the alarms having the effect of deterring theft. However, many such alarms are complex, constitute an extensive departure from already existing conventional display and dispensing apparatus, as well as expensive installation requirements, leading to greater costs of doing business. The present invention provides a simple improvement easily adapted to a conventional display and dispensing apparatus, requiring minimal modification for supplying an audible signal that serves to alert sales staff and thereby deter theft at the dispensing location of a display and dispensing apparatus of the kind described above.

Figure 4:
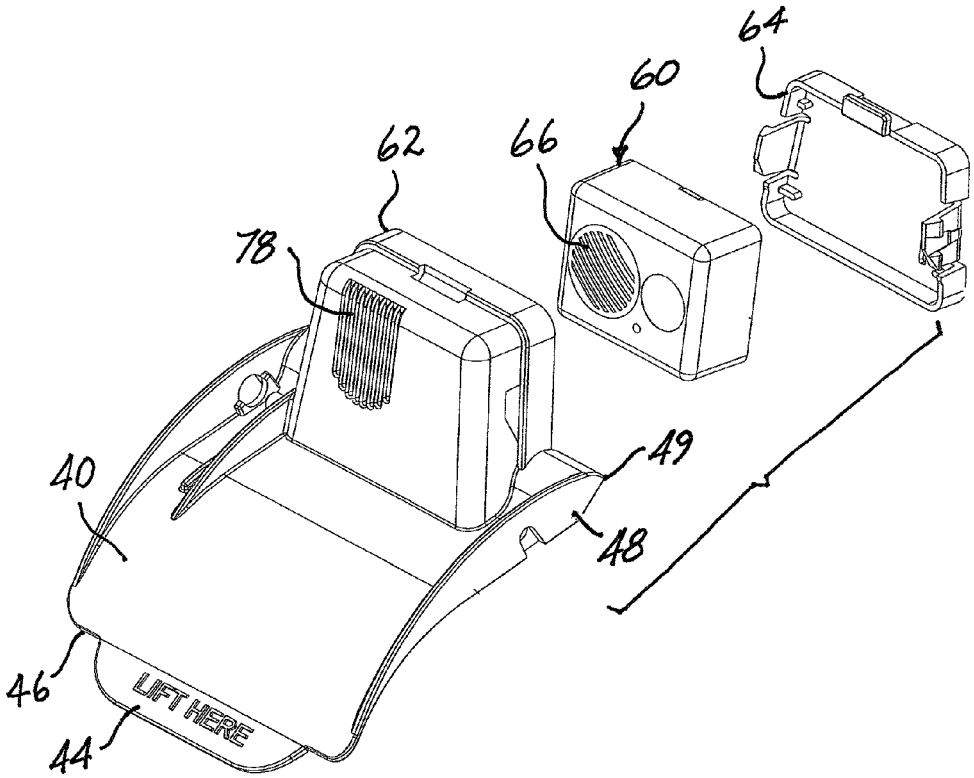
FIG. 4 is an enlarged, exploded pictorial view showing component parts of the improvement.
Figure 5:
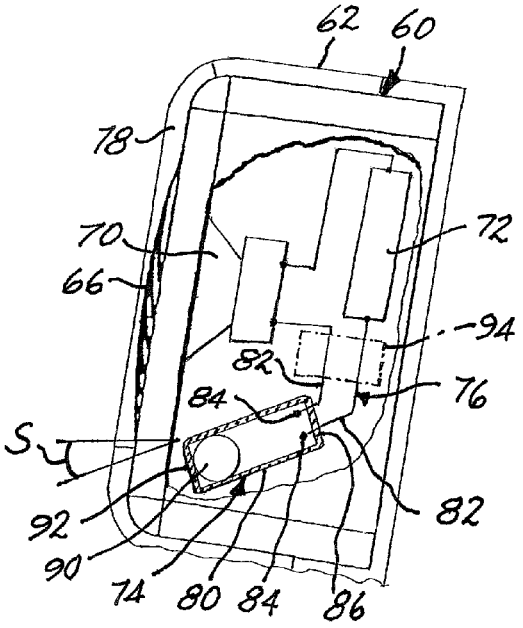
FIG. 5 is an enlarged, largely diagrammatic view of certain component parts, illustrating operation of the improvement of the invention.
Figure 6:
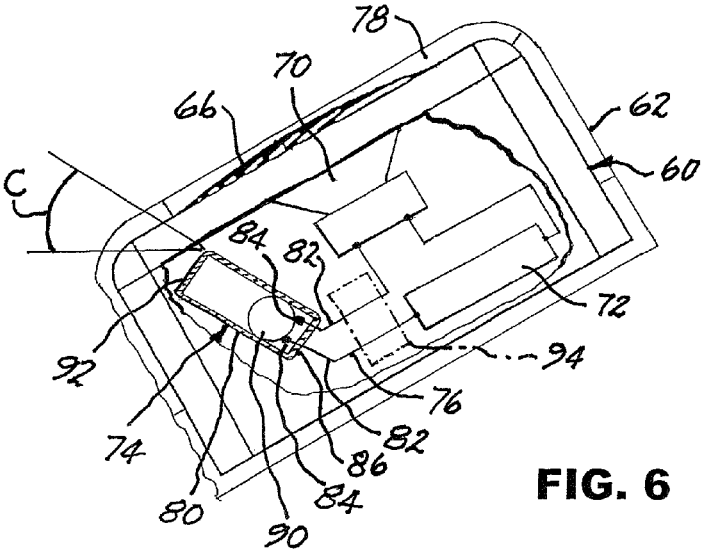
FIG. 6 is an enlarged, largely diagrammatic view similar to FIG. 5 and showing the component parts in another position during operation of the improvement.
Figure 8:
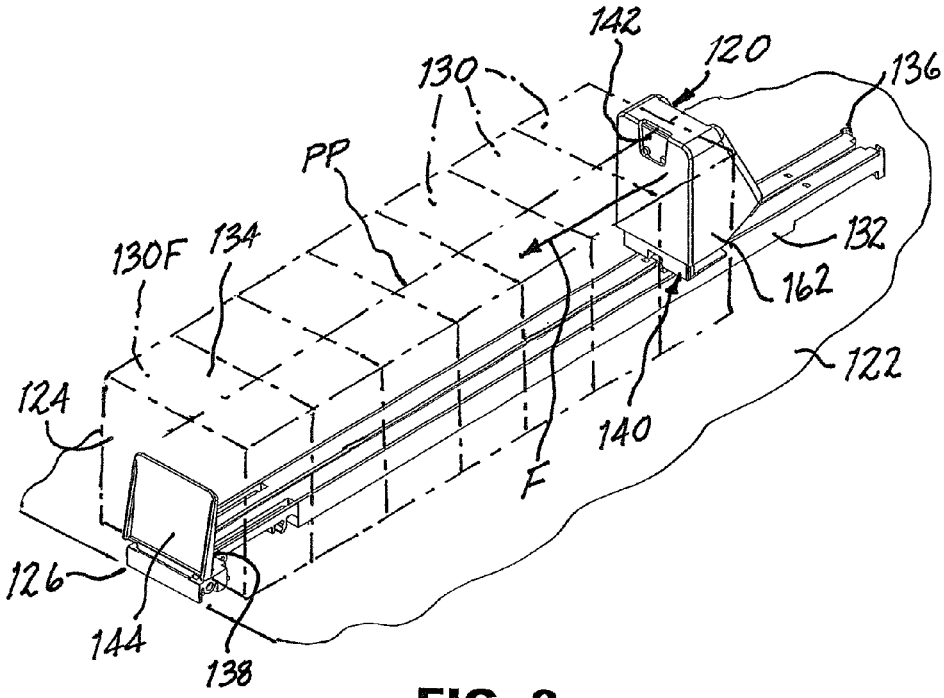
FIG. 8 is a front, top, right side pictorial view of another apparatus incorporating the improvement of the present invention.

With reference now to FIGS. 4 through 6, as well as to FIGS. 1 through 3, an annunciator assembly 60 is placed within the apparatus 20, mounted for movement with access door 40 as access door 40 is moved between the closed position depicted in FIG. 2 and the open position depicted in FIG. 3. To that end, annunciator assembly 60 is captured within a casing 62 integrated with access door 40, secured in place within casing 62 by a cover 64 affixed to the casing 62. An annunciator is located within annunciator assembly 60, behind a grill 66, and is shown diagrammatically at 70, connected to a source of electric power, shown diagrammatically as a battery pack 72, through an activator in the form of an electrical switch 74 within an electrical circuit 76. Upon closing switch 74, power is directed to annunciator 70, causing annunciator 70 to emit an audible signal which will pass through grill 66 of annunciator assembly 60, and through a slotted opening 78 in casing 62 to announce a selection, by virtue of the movement of access door 40 from the closed position depicted in FIG. 2 to the open position depicted in FIG. 3. An annunciator assembly suitable for use as described above is available commercially from Rocket Productions USA LLC, located in Lawrence, N.Y.

As best seen in FIGS. 5 and 6, electrical switch 74 is responsive to motion in powering annunciator 70 toward emitting the audible signal. Thus, switch 74 includes a tubular member 80 constructed of electrical insulation, within which tubular member 80 leads 82 of electrical circuit 76 are terminated at terminals 84 placed adjacent one end 86 of tubular member 80. At least one rolling member, illustrated in the form of a ball 90 of electrically conductive material, is placed within tubular member 80 for free rolling movement between end 86 and opposite end 92 of tubular member 80. As seen in FIG. 5, switch 74 is affixed, relative to casing 62 and access door 40, with tubular member 80 oriented at a shallow angle S to the horizontal direction, placing end 92 below end 86, when access door 40 is in the closed position depicted in FIG. 2, angle S being chosen to assure that ball 90 is biased, by gravity, toward juxtaposition with end 92 of tubular member 80, away from any contact with terminals 84 at end 86, thereby maintaining switch 74 open. Upon movement of access door 40 into the open position depicted in FIG. 3, tubular member 80 will become oriented at angle C with the horizontal direction, placing end 86 below end 92, angle C being great enough to bias ball 90, by gravity, into contact with terminals 84, thereby closing switch 74 and activating annunciator 70 to emit an audible signal announcing a selection made at dispensing location 24. Thus, access door 40 is movable between the closed position and the open position through an angular displacement sufficient to effect corresponding re-orientation of the tubular member 80, relative to the horizontal direction, toward actuating switch 74 between an open condition and a closed condition. In the preferred construction, angles S and C are about 20° to 30°. Having thus alerted nearby store personnel, theft of the item 30F at the dispensing location 24 effectively is deterred.

Figure 7:
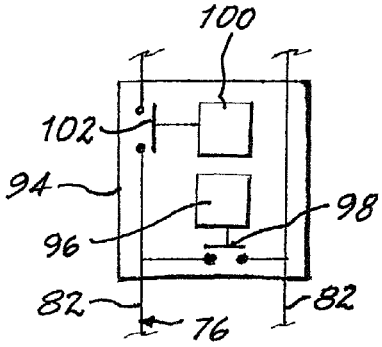
FIG. 7 is a largely schematic diagram of an optional component.

Upon return of the access door 40 to the closed position, ball 90 will roll away from contact with terminals 84 thereby opening switch 74 and terminating the audible signal, thus limiting the duration of the audible signal. However, in a preferred construction, electrical circuit 76 includes a timing device 94 for assuring that the audible signal is sounded for a predetermined limited duration after activation of the annunciator 70 by switch 74, independent of the subsequent orientation of tubular member 80. To that end, and with reference to FIG. 7, timing device 94 includes a first timer 96 which, upon closing switch 74, is activated to close a secondary switch 98 for a predetermined timed interval, thereby assuring that annunciator 70, in turn, remains activated to emit the audible signal for a corresponding predetermined limited duration, independent of the condition of switch 74. Should switch 74 remain closed for a duration that might exceed the desired predetermined timed interval, a second timer 100, within timing device 94, will open a further switch 102, thereby discontinuing activation of annunciator 70, thus limiting the audible signal to the desired predetermined limited duration, independent of the condition of switch 74.

It is noted that the present improvement is adapted readily to the conventional construction of apparatus 20, annunciator assembly 60 being self-contained and compact, while casing 62 is accommodated easily within the space 110 available between upper and lower chutes 32 and 34, without the necessity for further facilities.

Turning now to FIGS. 8 through 14, another apparatus incorporating the improvement of the present invention is shown at 120 and is seen to be placed on a shelf 122 extending along a horizontal direction to establish a dispensing location 124 at a point-of-purchase 126 where a purchaser (not shown) may select an item of merchandise, illustrated in phantom in the form of items 130, to be dispensed at the dispensing location 124 for purchase at the point-of-purchase 126. Apparatus 120 is of the type having a track 132 upon which items 130 are arranged serially, in a column 134 extending along a path of travel PP between a rearward end 136 and a forward end 138 of the track 132. In a now-conventional manner, a pusher assembly 140 includes a pusher 142 and is biased in the forward direction indicated by arrow F, to engage column 134 and bias items 130 in the forward direction F toward a front barrier 144 fixed in place adjacent the forward end 138 of track 132, where the forward-most item 130F is placed at the dispensing location 124. In this manner, item 130F is displayed for selection at the dispensing location 124.

Figure 9:
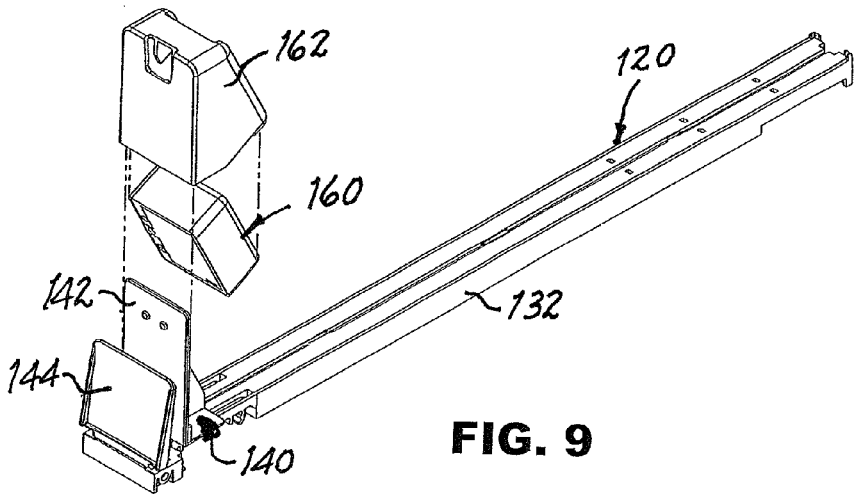
FIG. 9 is a front, top, right side pictorial view of component parts of the apparatus, exploded to show details of construction.
Figure 10:
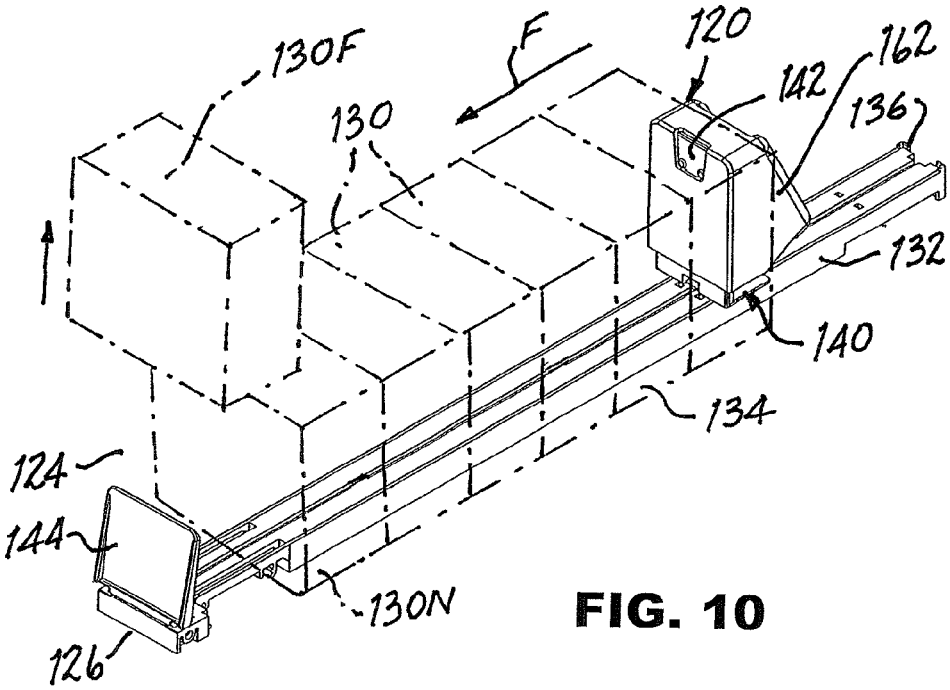
FIG. 10 is a pictorial view similar to FIG. 8 and illustrating operation of the embodiment shown.

The present invention provides an improvement for announcing the selective removal of item 130F from the dispensing location 124. To that end, an annunciator assembly 160 is placed within the apparatus 120, as shown in FIG. 9, mounted for movement with pusher assembly 140 as the pusher assembly 140 moves in the forward direction F, from the position shown in FIG. 10 to the position shown in FIG. 11, in response to removal of the forward-most item 130F, as illustrated in FIG. 10. Annunciator assembly 160 is captured in a casing 162 coupled with pusher 142 so as to be integrated with pusher assembly 140, with annunciator assembly 160 secured in place within casing 162 such that pusher assembly 140, casing 162 and annunciator assembly 160 move as a unit.

Figure 11:
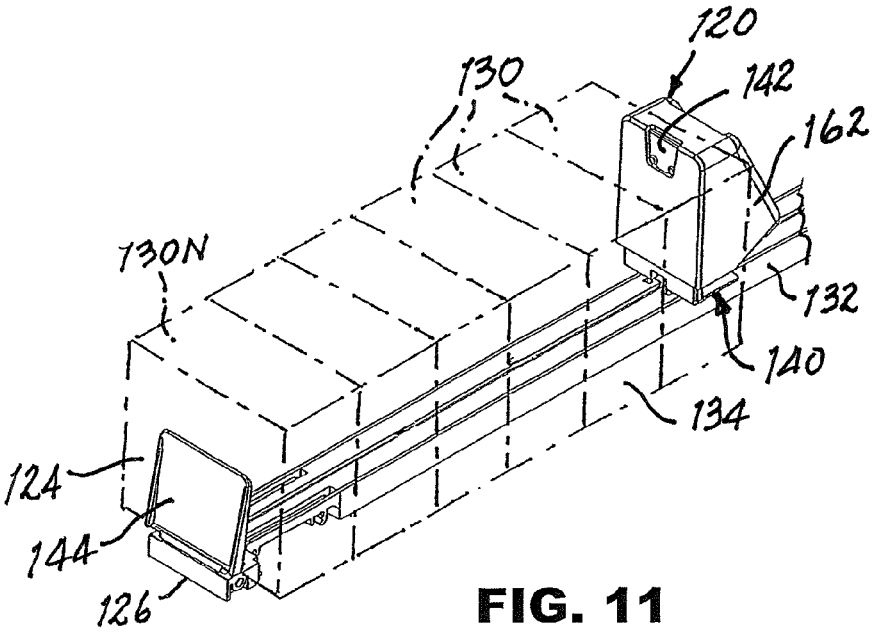
FIG. 11 is a pictorial view similar to FIG. 8, with the component parts in still another operating position.
Figure 12:
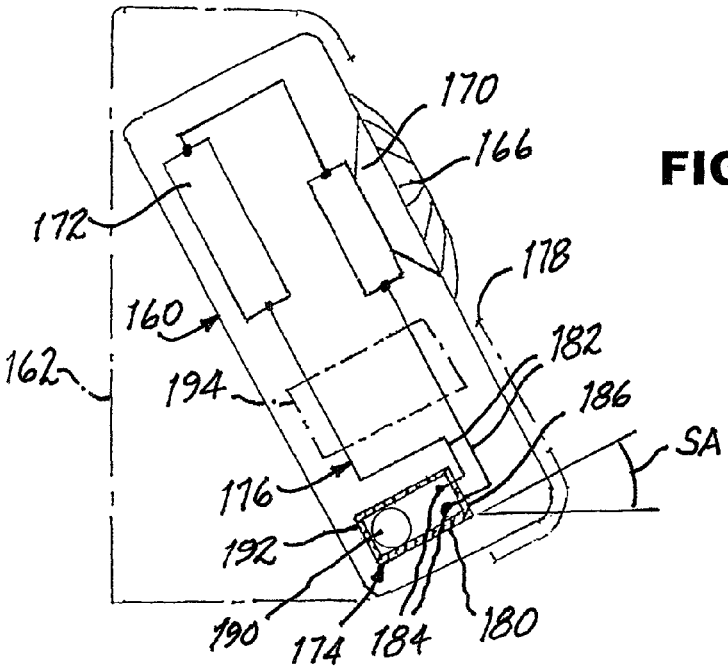
FIG. 12 is an enlarged, largely diagrammatic view of certain component parts, illustrating operation of the embodiment.
Figure 14:
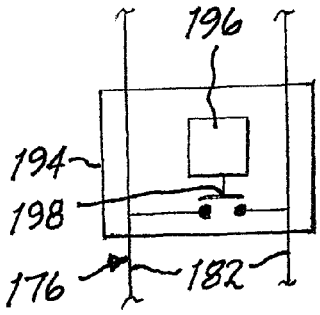
FIG. 14 is a largely schematic diagram of an optional component of the embodiment.
Figure 13:
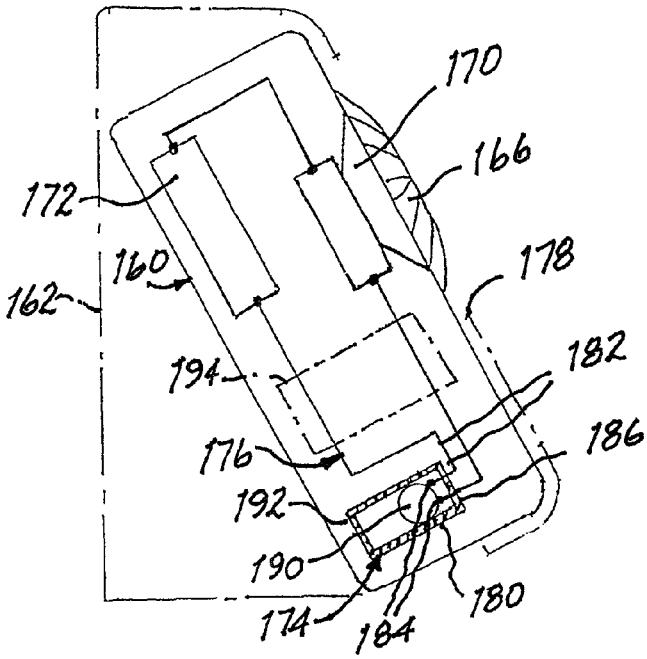
FIG. 13 is an enlarged, largely diagrammatic view similar to FIG. 11 and showing the component parts in another position during operation of the embodiment.

With reference to FIGS. 12 and 13, an annunciator is located within annunciator assembly 160, behind a grill 166, and is shown diagrammatically at 170, connected to a source of electric power, shown diagrammatically as a battery pack 172, through an activator in the form of an electrical switch 174 within an electrical circuit 176. Upon closing switch 174, power is directed to annunciator 170 activating annunciator 170 to emit an audible signal which will pass through grill 166 of annunciator assembly 160, and through an opening 178 in casing 162, to announce movement of pusher assembly 140 in the forward direction F, as depicted in FIGS. 10 and 11.

As best seen in FIGS. 12 and 13, electrical switch 174 is responsive to motion in powering annunciator 170 toward emitting the audible signal. Thus, switch 174 includes a tubular member 180 constructed of electrical insulation, within which tubular member 180 leads 182 of electrical circuit 176 are terminated at terminals 184 placed at one end 186 of tubular member 180. At least one rolling member, illustrated in the form of a ball 190 of electrically conductive material, is placed within tubular member 180 for free rolling movement between end 186 and opposite end 192 of tubular member 180. As seen diagrammatically in FIG. 12, switch 174 is mounted for movement with pusher assembly 140, with tubular member 180 oriented at a shallow angle SA to the direction F, placing end 192 of tubular member 180 below end 196, angle SA being chosen to assure that ball 190 is biased, by gravity, toward juxtaposition with end 192 of tubular member 180, away from any contact with terminals 184 at end 186, thereby maintaining switch 174 open while pusher assembly 140 is stationary. Upon movement of pusher assembly 140 in the direction F, in response to selective removal of an item 130 from dispensing location 124, as depicted in FIG. 10, ball 190 will be biased, by virtue of the acceleration of pusher assembly 140 in the direction F, into contact with terminals 184, as illustrated in FIG. 13, thereby closing switch 174 and activating annunciator 170 to emit an audible signal announcing a selection and removal effected at dispensing location 124. Thus, angle SA is chosen to enable the traverse of ball 190 from end 192 of tubular member 180 toward end 186 and into contact with terminals 184 in response to such movement of pusher assembly 140. In the preferred construction, angle SA is about 20° to 30°. Having thus alerted nearby store personnel, theft of the item 130 drawn from the dispensing location 124 effectively is deterred. It is noted that removal of any item 130 from column 134 will result in a movement of pusher assembly 142 sufficient to activate annunciator 170 to emit an audible signal, as described above, announcing the removal of that item 130, thereby deterring the theft of any one of items 130 held in column 134.

Upon the relatively sudden cessation of forward movement of pusher assembly 140, subsequent to removal of an item 130 from the apparatus 120, and the resulting advancement of the column 134 of items 130 until the next-consecutive item 130N reaches barrier 144, as seen in FIG. 11, ball 190 will roll away from contact with terminals 184, by virtue of rapid deceleration of the pusher assembly 140 and the concomitant deceleration of tubular member 180, as well as by gravity, thereby opening switch 174 and terminating the audible signal, thus limiting the duration of the audible signal. However, in a preferred construction, electrical circuit 176 includes a timing device 194 for assuring that the audible signal is sounded for a limited predetermined duration after activation of the annunciator 170 by switch 174, independent of any subsequent movement or later position of pusher assembly 140. To that end, and with reference to FIG. 14, timing device 194 includes a timer 196 which, upon closing switch 174, is activated to close a secondary switch 198 for a predetermined timed interval, thereby assuring that annunciator 170, in turn, remains activated to emit the audible signal for a corresponding predetermined limited duration, independent of the condition of switch 174.

Annunciator assembly 160 is adapted readily into apparatus 120, being self-contained and compact for ready accommodation within casing 162 which, in turn, is fitted easily onto pusher 142 for movement with pusher assemble 140.

It will be seen that the present invention attains all of the objects and advantages summarized above, namely: Provides a simple, effective and relatively inexpensive improvement for deterring theft at an apparatus for displaying and dispensing items of merchandise at a point-of-purchase; is self-contained and compact, adapted easily to current designs of apparatus for displaying and dispensing items of merchandise at a point-of-purchase, rendering widespread use both practical and readily accepted; provides an announcement of a selection made at a dispensing location for items of merchandise, effective to deter theft at a point-of-purchase; places an unobtrusive mechanism in connection with a dispensing location for signaling a selection made at a point-of-purchase, with an audible signal of predetermined duration; enables ready installation and use, without the necessity for special facilities or utilities at the installation location; provides a highly effective system and method for deterring theft at a point-of-purchase, capable of reliable operation over a long service life.

It is to be understood that the above detailed description of preferred embodiments of the invention is provided by way of example only. Various details of design, construction and procedure may be modified without departing from the true spirit and scope of the invention, as set forth in the appended claims.

The invention claimed is:

1. An improvement for deterring theft at an apparatus for displaying serially arranged items of merchandise advanced along a path of travel to a dispensing location at a point-of-purchase for selection and removal of an item of merchandise from the serially arranged items of merchandise, the improvement comprising:

an annunciator assembly mounted within the apparatus, the annunciator assembly including an annunciator for emitting an audible signal of limited duration upon activation of the annunciator;

a motion-responsive activator coupled with the annunciator for activating the annunciator to emit the audible signal of limited duration in response to imparting an activating motion to the activator; and a selection-responsive component mounted upon the apparatus in juxtaposition with the path of travel and coupled with the activator, the selection-responsive component being movable upon selection and removal of an item of merchandise from the serially arranged items of merchandise to impart an activating motion to the activator and, consequently, activating the annunciator to emit the audible signal of limited duration announcing the selection and removal;

wherein the selection-responsive component comprises an access door placed at the dispensing location, the access door being mounted for movement between a closed position, wherein access to a merchandise item at the dispensing location is precluded, and an open position, wherein access to the merchandise item at the dispensing location is permitted, at least the activator being mounted on the access door such that movement of the access door from the closed position to the open position to enable a selection and removal of the merchandise item at the dispensing location will impart a motion to the motion-responsive activator sufficient to activate the annunciator to emit the audible signal of limited duration announcing the selection.

2. The improvement of claim 1 wherein the annunciator assembly is mounted upon the access door for movement with the access door.

3. The improvement of claim 2 wherein the access door is mounted for pivotal movement through an angular displacement between the closed position and the open position, the angular displacement being sufficient to move the activator to activate the annunciator to emit the audible signal of limited duration announcing the selection.

4. The improvement of claim 3 wherein:

the annunciator assembly includes a self-contained source of electrical power for powering the annunciator for the emission of the audible signal; and the motion-responsive activator comprises a motion-actuated electrical switch;

the motion-actuated electrical switch being interposed between the self-contained source of electrical power and the annunciator for initiating the limited duration of the audible signal upon movement of the selection-responsive component.

5. The improvement of claim 4 including a timing device for establishing the duration of the audible signal.

6. An improvement for deterring theft at an apparatus for displaying serially arranged items of merchandise advanced along a path of travel to a dispensing location at a point-of-purchase for selection and removal of an item of merchandise from the serially arranged items of merchandise, the improvement comprising:

an annunciator assembly mounted within the apparatus, the annunciator assembly including an annunciator for emitting an audible signal of limited duration upon activation of the annunciator;

a motion-responsive activator coupled with the annunciator for activating the annunciator to emit the audible signal of limited duration in response to imparting an activating motion to the activator; and a selection-responsive component mounted upon the apparatus in juxtaposition with the path of travel and coupled with the activator, the selection-responsive component being movable in response to effecting a selection and removal of an item of merchandise from the serially arranged items of merchandise to impart an activating motion to the activator and, consequently, activating the annunciator to emit the audible signal of limited duration announcing the selection and removal;

wherein the apparatus includes a track along which track the items of merchandise are advanced along the path of travel to the dispensing location, and the selection-responsive component of the improvement comprises a pusher mounted for movement along the track; and a biasing arrangement for biasing the pusher toward the dispensing location to engage and advance the items of merchandise along the path of travel to the dispensing location, at least the activator being mounted on the pusher such that upon removal of a selected item of merchandise from the serially arranged items of merchandise, a corresponding movement of the pusher will impart a motion to the motion-responsive activator and, consequently, activate the annunciator to emit the audible signal of limited duration announcing the selection and removal.

7. The improvement of claim 6 including a timing device for establishing the duration of the audible signal.

8. The improvement of claim 6 wherein the annunciator assembly is mounted upon the pusher for movement with the pusher.

9. The improvement of claim 6 wherein:

the annunciator assembly includes a self-contained source of electrical power for powering the annunciator for the emission of the audible signal of limited duration; and the motion-responsive activator comprises a motion-actuated electrical switch;

the motion-actuated electrical switch being interposed between the self-contained source of electrical power and the annunciator for initiating the limited duration of the audible signal upon movement of the selection-responsive component.

10. The improvement of claim 9 including a timing device for establishing the duration of the audible signal.

11. A method for announcing the selection and removal of an item of merchandise from an apparatus for displaying and dispensing serially arranged items of merchandise advanced along a path of travel to a dispensing location at a point-of-purchase, the method comprising:

mounting an annunciator assembly within the apparatus, the annunciator assembly including an annunciator for emitting an audible signal of limited duration upon activation of the annunciator;

coupling a motion-responsive activator with the annunciator for activating the annunciator to emit the audible signal of limited duration in response to imparting an activating motion to the activator; and mounting a selection-responsive component upon the apparatus in juxtaposition with the path of travel and coupling selection-responsive component with the activator, such that the selection-responsive component is movable in response to effecting a selection at the dispensing location to impart an activating motion to the activator and, consequently, activating the annunciator to emit the audible signal of limited duration announcing the selection;

wherein the selection-responsive component comprises an access door placed at the dispensing location, the method including mounting the access door for movement between a closed position, wherein access to a merchandise item at the dispensing location is precluded, and an open position, wherein access to the merchandise item at the dispensing location is permitted, and mounting at least the activator on the access door such that movement of the access door from the closed position to the open position to enable a selection will impart a motion to the motion-responsive activator sufficient to activate the annunciator to emit the audible signal of limited duration announcing the selection.

12. The method of claim 11 including mounting the annunciator assembly upon the access door for movement with the access door.

13. The method of claim 11 including providing the apparatus with a timing device for establishing the duration of the audible signal.

14. A method for announcing the selection and removal of an item of merchandise from an apparatus for displaying and dispensing serially arranged items of merchandise advanced along a path of travel to a dispensing location at a point-of-purchase, the method comprising:

mounting an annunciator assembly within the apparatus, the annunciator assembly including an annunciator for emitting an audible signal of limited duration upon activation of the annunciator;

coupling a motion-responsive activator with the annunciator for activating the annunciator to emit the audible signal of limited duration in response to imparting an activating motion to the activator; and mounting a selection-responsive component upon the apparatus in juxtaposition with the path of travel and coupling selection-responsive component with the activator, such that the selection-responsive component is movable in response to effecting a selection and removal of an item of merchandise from the serially arranged items of merchandise to impart an activating motion to the activator and, consequently, activating the annunciator to emit the audible signal of limited duration announcing the selection and removal;

wherein the apparatus includes a track along which track the items of merchandise are advanced along the path of travel to the dispensing location, the method further comprising mounting a pusher for movement along the track;

mounting at least the activator on the pusher; and biasing the pusher toward the dispensing location to engage and advance the items of merchandise along the path of travel to the dispensing location such that upon removal of a selected item of merchandise from the serially arranged items of merchandise, a corresponding movement of the pusher will impart a motion to the motion-responsive activator and, consequently, activate the annunciator to emit the audible signal of limited duration announcing the selection and removal.

15. The method of claim 14 including mounting the annunciator assembly on the pusher.

16. The method of claim 14 including providing the apparatus with a timing device for establishing the duration of the audible signal.

* * * * *